US005876886A

United States Patent [19]

Hashizume

[11] Patent Number: 5,876,886

[45] **Date of Patent: *Mar. 2, 1999**

[54] LIGHT-RECEIVING MEMBER AND ELECTROPHOTOGRAPHIC APPARATUS MAKING USE OF THE SAME

[75] Inventor: Junichiro Hashizume, Nara, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 574,920

[22] Filed: Dec. 19, 1995

[30] Foreign Application Priority Data

Dec. 21, 1994 [JP] Japan ..... 6-318236
Dec. 8, 1995 [JP] Japan ..... 7-319861

[51] Int. Cl.[6] ..... G03G 15/04

[52] U.S. Cl. ..... 430/57; 430/60; 430/64; 430/66; 430/69; 430/84

[58] Field of Search ..... 430/57, 60, 64, 430/66, 69, 84

[56] References Cited

U.S. PATENT DOCUMENTS 4,818,651 4/1989 Shirai et al. ..... 430/57
4,818,652 4/1989 Shirai et al. ..... 430/57
5,358,811 10/1994 Yamazaki et al. ..... 430/42
5,422,209 6/1995 Ono et al. ..... 430/57

FOREIGN PATENT DOCUMENTS 3943094 7/1990 Germany ..... G03G 5/043
4212230 10/1993 Germany ..... G03G 5/047

*Primary Examiner*—Marion McCamish
*Assistant Examiner*—Cheryl Juska
*Attorney, Agent, or Firm*—Fitzpatrick, Cella, Harper & Scinto

[57] ABSTRACT

A light-receiving member, and an electrophotographic apparatus comprising it, which the member comprises a conductive support, a first layer capable of exhibiting a photoconductivity which comprises at least a material of a non-single-crystal silicon type, a second layer comprising silicon atoms and one kind selected from the group consisting of carbon atoms, nitrogen atoms and oxygen atoms, and a third layer comprising silicon atoms and one kind selected from the group consisting of carbon atoms, nitrogen atoms and oxygen atoms, the conductivity type of which has been adjusted to be of the same polarity as charging polarity by incorporating at least one element belonging to the Group III elements of the periodic table, the first, second and third layers being superposingly provided in this order, wherein the light-receiving member is used for positive charging and requires no drum heater, thereby achieving a very good image quality in any environment.

51 Claims, 7 Drawing Sheets

LIGHT-RECEIVING MEMBER AND ELECTROPHOTOGRAPHIC APPARATUS MAKING USE OF THE SAME

BACKGROUND OF THE INVENTION

1. Field of the Invention

This invention relates to a light-receiving member used for an electrophotographic apparatus or the like, and an electrophotographic apparatus making use of the same. More particularly, it relates to a non-single-crystal silicon type light-receiving member that can faithfully reproduce fine lines and minute dots and also can obtain images with a good contrast and a very high image quality in image formation by an electrophotographic apparatus, a copying machine, an LBP, a printer, a display etc. utilizing electrophotographic technology, and an electrophotographic apparatus making use of the light-receiving member.

2. Related Background Art

Non-single-crystal silicon type light-receiving members have a high surface hardness, exhibit a high sensitivity to long-wavelength light of semiconductor lasers (770 to 800 nm) or the like and also are almost free from deterioration due to repeated use. Hence, they are highly valued and put into use especially as light-receiving members for electrophotographic apparatus such as high-speed copying machines and LBPs (laser beam printers) employing the above semiconductor lasers. Such non-single-crystal silicon type light-receiving members, and copying machines and image forming processes making use of them can be generally exemplified as follows:

FIG. 1 is a diagrammatic cross section of a typical light-receiving member. Reference numeral 101 denotes a conductive support made of Al or the like; 102, a charge injection blocking layer for blocking the injection of charges from the conductive support 101; 103, a photoconductive layer comprised of at least a material of a non-single-crystal silicon type and capable of exhibiting photoconductivity; and 104, a surface protective layer for protecting the photoconductive layer 103.

FIG. 2 schematically illustrates an example of an image forming process in a copying machine. Around a light-receiving member 401 that rotates in the direction of an arrow, a primary charging unit 402, an electrostatic latent image forming zone 403, a developing unit 404, a transfer medium feed system 405, a transfer/separation charging unit 406, a cleaner 407, a convey system 408, a charge elimination light source 409 and so forth are provided as occasion calls.

The light-receiving member 401, having been heated by a heater 423, is uniformly charged by the primary charging unit 402. Then, light which has been emitted from a light source 410 such as a halogen lamp or a fluorescent lamp, is irradiated on an original 412 put on a platen glass 411 and light reflected therefrom is led onto the surface of the light-receiving member through mirrors 413 to 416, a lens system 417 and a filter 418 and projected thereon to form an electrostatic latent image, and a toner is fed to this latent image from the developing unit 404 to form a toner image.

Meanwhile, a transfer medium P such as a sheet of paper or plastic is fed in the direction of the light-receiving member through the transfer medium feed system 405 having a transfer medium path 419 and a resist roller 422. Then, an electric field with a polarity opposite to that of the toner is imparted on its rear side and at the gap between the transfer/separation charging unit 406 and the light-receiving member 401. As the result, the toner image on the surface of the light-receiving member is transferred to the transfer medium P and at the same time the transfer medium P is separated from the light-receiving member 401.

The transfer medium P thus separated is passed through the conveying system 408 to a fixing unit (not shown), where the toner image is fixed, and then discharged from the apparatus.

In the transfer zone, the residual toner remaining on the surface of the light-receiving member without contributing to the transfer is conveyed to the cleaner 407 and is removed by a cleaning blade 421, so that the surface of the light-receiving member is cleaned.

The surface of the light-receiving member refreshed as a result of the cleaning is subjected to charge elimination exposure applied from the charge elimination light source 409 and is again subjected to the image forming process cycle.

Now, the non-single-crystal silicon type light-receiving member used in the image forming process as described above has not only the advantage that it has a high sensitivity to long-wavelength light as stated above (sensitivity peak: around 680 nm; sensitivity region: 400 to 800 nm), but also a satisfactory standard in practical use since it does not cause a lowering of image quality such as crushed characters or slim lines, in an instance where it is used in an electrophotographic image forming apparatus and copies of documents are taken in an office having normal temperature and humidity. However, it does not necessarily meet the recent requirements for an image quality comparable to that in printing or even higher than that.

More specifically, when the non-single-crystal silicon type light-receiving member is used in an electrophotographic process and very fine lines of about 100 $\mu$m or less are reproduced in an environment of high temperature and humidity, e.g., 30° C./80% RH, a sufficient density cannot be obtained and also line breadth may become larger in some cases. For example, in an attempt where a Chinese character "鬱", having complicated strokes and a four-cornered boxy component "□", is printed in a region of 2 mm square, its four-cornered boxy component may crush to make the character illegible. Similarly, in an attempt where a Chinese character "電", having many strokes in the horizontal direction, is printed in a region of 2 mm square, the horizontal lines composing this character may blur to make the character illegible. Such a level of blurred outputs can not be said to be satisfactory for good resolution, and it follows that no high level of satisfaction can be achieved in some cases with respect to not only the level of image quality required in the field of printing industry, but, also the level of image quality required in offices. Such unsatisfactory results may lead to the conclusion that the image quality is substantially "unacceptable" for commercial copying. Conventionally, to avoid such problems, for example, heater (in FIG. 2, a heater 423) is provided inside the substrate of the light-receiving member and the heater 423 is electrified to raise the surface temperature of the light-receiving member to lower the relative humidity so that good reproducibility can be ensured. This method causes an increase in power consumption of the whole copying machine to bring about an economical disadvantage, but the power to the heater must be kept on even at night during which the copying machine is not used at all, in order to ensure satisfactory image reproducibility when first used in the morning and to ensure good image quality when used in an environment of high humidity. Accordingly, to save energy and natural resources, it has been deemed desirable to develop a light-receiving member requiring no heater.

SUMMARY OF THE INVENTION

An object of the present invention is to solve the problems discussed above and provide a light-receiving member that requires no heating mechanism for heating the light-receiving member and can achieve a very good image quality, and an electrophotographic apparatus having such a light-receiving member.

Another object of the present invention is to provide a light-receiving member that can obtain images having a very stable and good sharpness without dependence on environment, and an electrophotographic apparatus having such a light-receiving member.

Still another object of the present invention is to provide an electrophotographic apparatus that requires less power consumption on the whole, is economical and also has a low impact upon global environment, and a light-receiving member most suitably usable in such an apparatus.

A further object of the present invention is to provide a light-receiving member comprising a conductive support; and provided thereon a first layer capable of exhibiting photoconductivity which comprises at least a material of a non-single-crystal silicon type; a second layer comprising silicon atoms and at least one kind selected from the group consisting of carbon atoms, nitrogen atoms and oxygen atoms; and a third layer comprising silicon atoms and at least one kind selected from the group consisting of carbon atoms, nitrogen atoms and oxygen atoms, the conductivity type of which has been adjusted to be of the same polarity as charging polarity by incorporating at least one kind belonging to the Group III elements of the periodic table, the first, second and third layers being deposited in this order on the conductive support, wherein the light-receiving member is used for positive charging, and to provide an electrophotographic apparatus having this light-receiving member.

DESCRIPTION OF THE PREFERRED EMBODIMENTS

Figure 1:
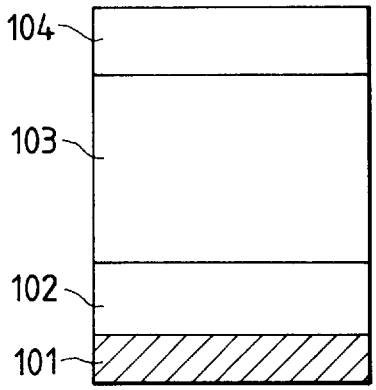
FIG. 1 is a diagrammatic structural view to illustrate an example of layer configuration of a light-receiving member.

As a result of extensive studies made by the present inventor through trial and error, he has discovered that the objects of the present invention can be achieved by a light-receiving member and an electrophotographic apparatus having the light-receiving member, which comprises a conductive support; a first layer capable of exhibiting a photoconductivity which comprises at least a material of a non-single-crystal silicon type; a second layer comprising silicon atoms and at least one kind selected from the group consisting of carbon atoms, nitrogen atoms and oxygen atoms, and optionally containing at least one kind selected from the group consisting of hydrogen atoms and halogen atoms; and a third layer comprising silicon atoms and at least one kind selected from the group consisting of carbon atoms, nitrogen atoms and oxygen atoms, and optionally containing at least one kind selected from the group consisting of hydrogen atoms and halogen atoms, the conductivity type of which has been adjusted to be of the same polarity as charging polarity by incorporating at least one kind belonging to the Group III elements of the periodic table, the layers being deposited in this order on the conductive support, wherein the light-receiving member is used for positive charging. Then, he has discovered that the use of the light-receiving member basically having such a specific constitution makes it possible to obtain transferred images with a high density and a good sharpness without dependence on environment even if a heating mechanism for heating the light-receiving member is not provided, and also to obtain transferred images in a stabler and higher image quality than ever.

The conductivity type of the second layer may preferably be adjusted to be of a polarity opposite to charging polarity.

The specific effect of the present invention stated above have been made clear from a series of experiments described later, and the reason therefor can not necessarily be said to be clear at present. At present, the inventor presumes it as follows:

In the light-receiving member of the present invention, the semiconductor properties of the third layer, positioned at the outermost surface, are not adjusted to be of a polarity opposite to charging polarity as hitherto ordinarily so, but controlled so as to be of the same polarity as charging polarity by doping the layer with an impurity belonging to the Group III elements of the periodic table. Hence, it is considered that electric charges produced by charging pass through the third layer and the latent image holding region is held inside the light-receiving member. Since the charged carriers are held inside the photoconductive layer in this way and come to stand distant from the outermost surface of the light-receiving member, it is considered that the charged carriers become physically affected with difficulty and good images can be maintained also in an environment of high temperature and high humidity.

The experiments have also revealed that the light-receiving member of the present invention can achieve a potential contrast superior to that of conventional light-receiving members. The potential contrast means a potential difference between a dark portion potential and a light portion potential. When the potential difference becomes larger, the potential contrast becomes superior. This is a result unexpected by the present inventor. In respect of this result also, the details have not been made clear at present. However, the contrast of potential is improved in accordance with doping quantity only when the Group III element of the periodic table, to be incorporated into the third layer is doped in a quantity within a certain range, and hence it is presumed that the incorporation of the Group III element under control of its quantity within a certain range holds an important key.

In the light-receiving member of the present invention, especially good images are obtained when used in combination with an insulating toner having a volume average particle diameter of from 4.5 μm to 9.0 μm. This is considered to be a cooperative effect attributable to the formation of sharp latent images and the fine-particle toner having a high resolution.

By way of precaution, the constitution of the light-receiving member of the present invention will be further described.

The non-single-crystal silicon type material, e.g., amorphous silicon (microcrystalline silicon may be included) exhibits the p-type conductivity or properties close to the p-type conductivity when incorporated with the Group III element of the periodic table (e.g., boron, B; gallium, Ga; indium, Id). Hence, the fact that it exhibits the p-type conductivity or properties close to the p-type conductivity means that there is a hole. The hole acts like a positive electronic charge, and hence, when the charging polarity is positive, i.e., when positively charged, the same polarity is given to the layer exhibiting the p-type conductivity or properties close to the p-type conductivity.

What is meant by "the same polarity" in the present invention is generally as stated above.

Accordingly, it follows that the polarity opposite to the charging polarity corresponds to the n-type conductivity when the charging polarity is positive.

The present invention will be specifically described below with reference to the accompanying drawings.

Light-Receiving Member

Figure 3A:
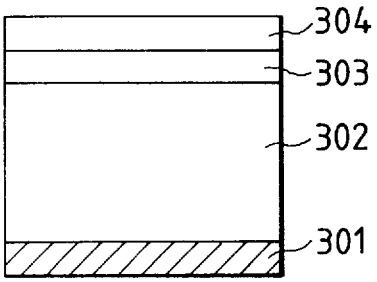
FIGS. 3A to 3C are diagrammatic structural views to illustrate other examples of layer configuration of the light-receiving member of the present invention.
Figure 3B:
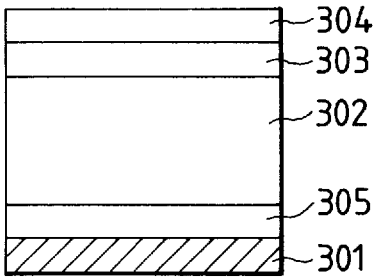
Figure 3C:
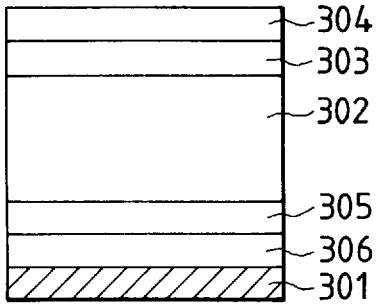

Diagrammatic cross sections of light-receiving members are shown in FIGS. 3A to 3C to illustrate examples of layer configuration of typical light-receiving members that can be used in the present invention. FIG. 3A illustrates the most basic constitution of the light-receiving member used in the present invention. In FIG. 3A, reference numeral 301 denotes a conductive support made of Al or the like. Reference numeral 302 denotes the first layer capable of exhibiting a photoconductivity, which is comprised of at least a material of a non-single-crystal silicon type; 303, the second layer substantially having the function to retain charged carriers, which comprises silicon atoms and at least one kind selected from the group consisting of carbon atoms, nitrogen atoms and oxygen atoms, and optionally at least one kind selected from the group consisting of hydrogen atoms and halogen atoms; and 304, the third layer comprising silicon atoms and at least one kind selected from the group consisting of carbon atoms, nitrogen atoms and oxygen atoms, and optionally at least one kind selected from the group consisting of hydrogen atoms and halogen atoms, the conductivity type of which has been adjusted to be of the same polarity as the charging polarity by doping the layer with a Group III element of the periodic table.

FIG. 3B illustrates a preferred embodiment of the light-receiving member used in the present invention. In FIG. 3B, reference numeral 305 denotes a charge injection blocking layer optionally provided between the conductive support 301 and the first layer 302, for blocking the injection of charges from the conductive support 301.

FIG. 3C illustrates another preferred embodiment of the light-receiving member used in the present invention. In FIG. 3C, reference numeral 306 denotes a long-wavelength absorption layer optionally provided between the conductive support 301 and the charge injection blocking layer 305, having the function to absorb long-wavelength light in order to prevent occurrence of a phenomenon of interference, which may occur because of a high transmission of long-wavelength light when a semiconductor laser that emits long-wavelength light is used as an imagewise exposure light source of an electrophotographic image forming apparatus and its coherent beams of light having reached the conductive support 301 reflect from the surface of the support 301. The charge injection blocking layer 305 may be omitted so that the first layer 302 is directly provided on the long-wavelength absorption layer 306. Also, the functions of both the long-wavelength absorption layer 306 and the charge injection blocking layer 305 may be held by either layer.

The first layer 302 is basically comprised of non-single-crystal silicon, and may optionally contain at least one kind selected from the group consisting of hydrogen atoms and halogen atoms. It may further optionally contain at least one kind of carbon atoms, germanium atoms, tin atoms, atoms belonging to the Group III of the periodic table (hereinafter simply "Group III atoms") and atoms belonging to the Group V of the periodic table (hereinafter simply "Group V atoms").

The content of hydrogen atoms or halogen atoms, or the total content of hydrogen atoms and halogen atoms to be incorporated into the first layer 302 may preferably be controlled in the range of from 0.1 to 40 atomic % based on the total content of silicon atoms, carbon atoms, germanium atoms and tin atoms.

When the Group III atoms are incorporated into the first layer, the content thereof may preferably be controlled to be not more than ⅕ of the content of the Group III atoms in the third layer 304.

The first layer 302 may preferably be formed in a layer thickness of from 1 to 100 μm.

The total content of at least one kind selected from the group consisting of carbon atoms, nitrogen atoms and oxygen atoms incorporated into the second layer 303 may preferably be so controlled that the quantity of the atoms selected may range from 30 to 90 atomic % based on the total quantity of silicon atoms and those atoms selected. The content of at least one kind selected from the group consisting of hydrogen atoms and halogen atoms may preferably be controlled to range from 0.1 to 70 atomic % based on the total quantity of silicon atoms, carbon atoms, nitrogen atoms and oxygen atoms. If the content, or the total content, of at least one kind selected from the group consisting of carbon atoms, nitrogen atoms and oxygen atoms is less than 30 atomic %, the charging performance, one of important electrical performances of the light-receiving member, may become insufficient in some cases. If necessary, at least one kind of germanium atoms, tin atoms, Group III atoms, Group V atoms and Group VI atoms may also be contained.

The second layer 303 may preferably be formed in a layer thickness of from 0.003 to 30 μm.

The total content of at least one kind selected from the group consisting of carbon atoms, nitrogen atoms and oxygen atoms incorporated into the third layer 304 may preferably be so controlled that the quantity of the atoms selected may range from 1 to 90 atomic % based on the total quantity of silicon atoms and those atoms selected, and more preferably be substantially the same content as the content of at least one kind selected from the group consisting of carbon atoms, nitrogen atoms and oxygen atoms incorporated into the second layer 303.

The content of at least one kind selected from the group consisting of hydrogen atoms and halogen atoms may preferably be controlled to range from 0.1 to 70 atomic % based on the total quantity of silicon atoms, carbon atoms, nitrogen atoms and oxygen atoms. The dopant incorporated is, when used for positive charging, selected from Group III atoms, and boron may preferably be used. Its content may preferably be not less than 300 atomic ppm, and more preferably not less than 1,000 atomic ppm, based on the contained silicon atoms. The Group III element incorporated may preferably be in a content not more than 20 atomic %. This is because, if doped in a large quantity, the image contrast may lower inversely to adversely affect the performance of the light-receiving member.

In order to make the present invention effective, it is suitable for the third layer 304 to have a layer thickness of from 0.2 to 10 $\mu$m, and its hole mobility may preferably be at least $5\times10^{-9}$ $cm^2/v\cdot s$ as calculated from dimensions and process speed as commonly applied in the Carlson process.

When the charge injection blocking layer 305 is provided, the layer is basically comprised of non-single-crystal silicon, and may optionally contain hydrogen atoms or halogen atoms. It may further contain at least one kind of carbon atoms, Group III atoms, Group V atoms and Group VI atoms.

The charge injection blocking layer 305 may preferably be formed in a layer thickness of from 0.03 to 15 $\mu$m.

When the long-wavelength absorption layer 306 is provided, the layer is basically comprised of non-single-crystal silicon, may optionally contain hydrogen atoms or halogen atoms, and may further contain germanium atoms or tin atoms. It may further optionally contain at least one kind of carbon atoms, Group III atoms, Group V atoms and Group VI atoms.

The long-wavelength absorption layer 306 may preferably be formed in a layer thickness of from 0.05 to 25 $\mu$m.

The above Group III atoms may specifically include boron (B), gallium (Ga), indium (In) and thallium (Tl). In particular, B and Ga are preferred. The Group V atoms may specifically include phosphorus (P), arsenic (As), antimony (Sb) and bismuth (Bi). In particular, P and As are preferred. The Group VI atoms may specifically include sulfur (S), selenium (Se), tellurium (Te) and polonium (Po). In particular, S and Se are preferred.

Production Process

The light-receiving member of the present invention can be produced by a vacuum deposition film forming process under conditions appropriately numerically set in accordance with film forming parameters so as to achieve the desired performances. Stated specifically, the vacuum deposition film forming process can be exemplified by glow discharging method including AC discharge plasma-assisted CVD such as low-frequency plasma-assisted CVD, high-frequency plasma-assisted CVD or microwave plasma-assisted CVD, and DC discharge plasma-assisted CVD method; ECR plasma-assisted CVD method; sputtering method; vacuum metallizing method; ion plating method; photo CVD method; a method in which an active species (A) produced by decomposition of a material gas for a deposited layer and an active species (B) produced from a film-forming chemical substances that chemically mutually acts with the active species (A) are separately introduced into a film-forming space where deposited films are formed, to cause these to chemically react to form a deposited layer (hereinafter simply "HRCVD method"); and a method in which a material gas for a deposited layer and a halogen based oxide gas (e.g., $F_2$ or $Cl_2$ capable of having oxidative effect on the material gas are separately introduced into a film-forming section where deposited films are formed, to cause these to chemically react to form the deposited layer (hereinafter simply "FOCVD method"); any of which may be used under appropriate selection. When these vacuum deposition film forming processes are employed, suitable ones are selected according to the conditions for manufacture, the extent of a load on capital investment in equipment, the scale of manufacture and the performances desired on light-receiving members produced. Glow discharging, sputtering, ion plating, HRCVD and FOCVD methods are preferred in view of their relative easiness to control conditions in the manufacture of light-receiving members having the desired performances. Layers may be formed using some of these methods in combination in the same reactor system.

Figure 4:
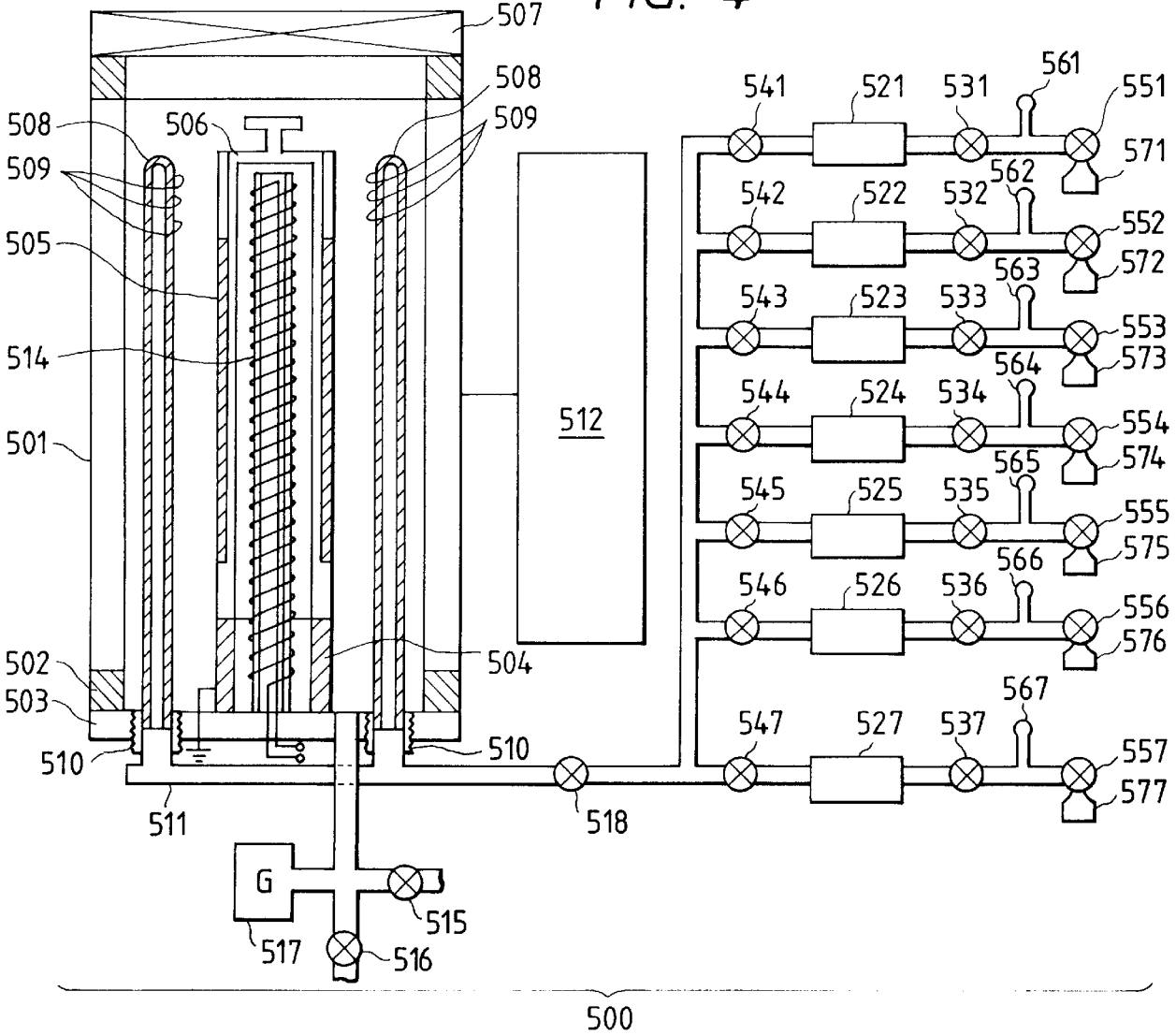
FIG. 4 is a diagrammatic structural view to illustrate an example of the film forming apparatus used in the present invention.

FIG. 4 schematically illustrates an example of a high-frequency (hereinafter simply "RF") plasma-assisted CVD apparatus, which is a typical deposited film forming apparatus that can be used to produce the light-receiving member of the present invention.

In FIG. 4, reference numerals 571 to 577 respectively denote gas cylinders. In these gas cylinders, material gases for forming the light-receiving member, e.g., $SiH_4$, $H_2$, $CH_4$, $PH_3$, $B_2H_6$, NO and Ar are respectively hermetically enclosed. These material gases have been introduced to gas pipes from valves 551 to 557 to flow-in valves 531 to 537, respectively, when the gas cylinders 571 to 577 are fitted.

An example of a procedure for film formation will be described below.

An aluminum cylinder (a cylindrical conductive support) 505 whose surface has been mirror-finished by means of, e.g., a lathe is inserted to a support holder 506. Then, a top cover 507 of a reactor (a film forming furnace) 501 is opened and the support holder 506 with the cylinder is inserted and set on a heater provided inside the film forming furnace 501.

Next, the valves 551 to 557 of the gas cylinders 571 to 577, flow-in valves 531 to 537 and a leak valve 515 of the film forming furnace 501 are checked to make sure that they are closed, and also flow-out valves 541 to 547 and an auxiliary valve 518 are checked to make sure that they are opened. Then, firstly a main valve 516 is opened to evacuate the insides of the film forming furnace 501 and a gas pipe 511 by means of a vacuum pump (not shown). After the evacuation has been completed, all the valves are once closed.

Thereafter, gas cylinder valves 551 to 557 are opened so that gases are respectively introduced from gas cylinders 571 to 577, and each gas is controlled to have the desired pressure by operating pressure controllers 561 to 567.

Next, the flow-in valves 531 to 537 are gradually opened so that gases are respectively introduced into mass flow controllers 521 to 527.

Then, the flow-out valve 547 and the auxiliary valve 518 are gradually opened so that Ar gas is fed into the film forming furnace 501 through gas release holes 509 of a gas feed pipe 508. Here, so as to provide the desired pressure of Ar gas flow rate, the evacuation rate of an exhaust system (not shown) is adjusted while watching a vacuum gauge 517.

Thereafter, a temperature controller (not shown) is operated to heat the support 505 by means of the heater 514. At the time the support 505 has been heated to the desired temperature, the flow-out valve 547 and the auxiliary valve 518 are closed to stop the gas flowing into the film forming furnace 501.

Next, the flow-out valves 541 to 547 and the auxiliary valve 518 are gradually opened so that the material gases necessary to form the respective layers are fed into the film forming furnace 501 through the gas release holes 509 of the gas feed pipe 508. Here, the gas flow rates of the material gases are adjusted by the respective mass flow controllers 521 to 527 so as to provide the desired flow rates. To control the pressure inside the film forming furnace 501, the evacuation rate of the exhaust system (not shown) is adjusted while watching the vacuum gauge 517. Thereafter, the power of an RF power source (not shown) is set at the desired electric power, and an RF power is supplied to the inside of the film forming furnace 501 through a high-frequency matching box 512 to cause RF glow discharge to take place. Thus, the formation of the desired layer on the support 505 or on a layer having been formed is started. At the time the desired layers have been formed, the RF glow discharge is stopped, and the flow-out valves 541 to 547 and the auxiliary valve 518 are closed to stop gases from flowing into the film forming furnace 501. The formation of layers are thus completed. After the formation of layers has been completed, the top cover 507 is opened to take out the support 505 on which films have been formed. Here, the support 505 may preferably be taken out after its temperature has dropped to a desired degree.

Needles to say, when the respective layers are formed, the flow-out valves other than those for necessary gases are perfectly closed. Also, in order to prevent the corresponding gases from remaining in the film forming furnace 501 and in the pipe extending from the flow-out valves 541 to 547 to the film forming furnace 501, the flow-out valves 541 to 547 are closed, the auxiliary valve 518 is opened and then the main valve 516 is full-opened so that the inside of the system is once evacuated to a high vacuum; this may be optionally operated.

If necessary, in order to achieve uniform film formation, it is preferable to rotate the support 505 and the support holder 506 at the desired speed by means of a driving mechanism (not shown) while the films are formed.

Image Forming Process

Figure 5:
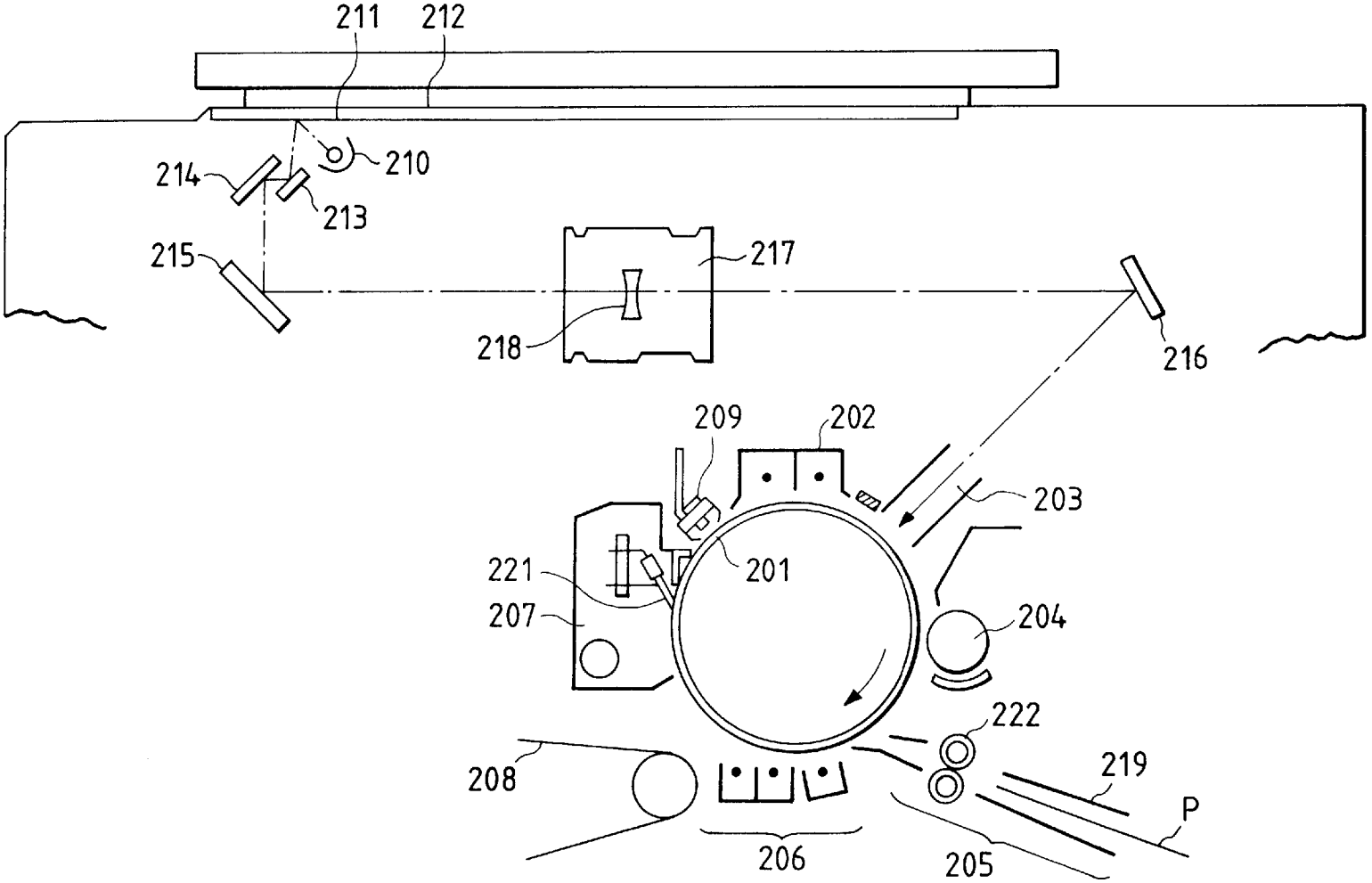
FIG. 5 is a diagrammatic structural view to illustrate an example of the electrophotographic apparatus of the present invention having no heater for heating the light-receiving member.

FIG. 5 diagrammatically illustrates a cross section of an example of the electrophotographic image forming apparatus used in the present invention. In FIG. 5, reference numeral 201 denotes a light-receiving member; 202, a primary charging unit; 203, an electrostatic latent image forming zone; 204, a developing unit; 205, a transfer medium feed system; 206, a transfer/separation charging unit; 207, a cleaner; 208, a transfer medium conveying system; 209, a charge elimination light source; 210, a light source such as a halogen lamp or a fluorescent lamp; 211, a platen glass; 212, an original; 213 to 216, mirrors; 217, a lens system; 218, a filter; 219, a transfer medium path; 221, a cleaning blade; and 222, a resist roller. What is greatly different from the apparatus shown in FIG. 2 is whether or not the apparatus has the heater for heating the light-receiving member 201.

Figure 2:
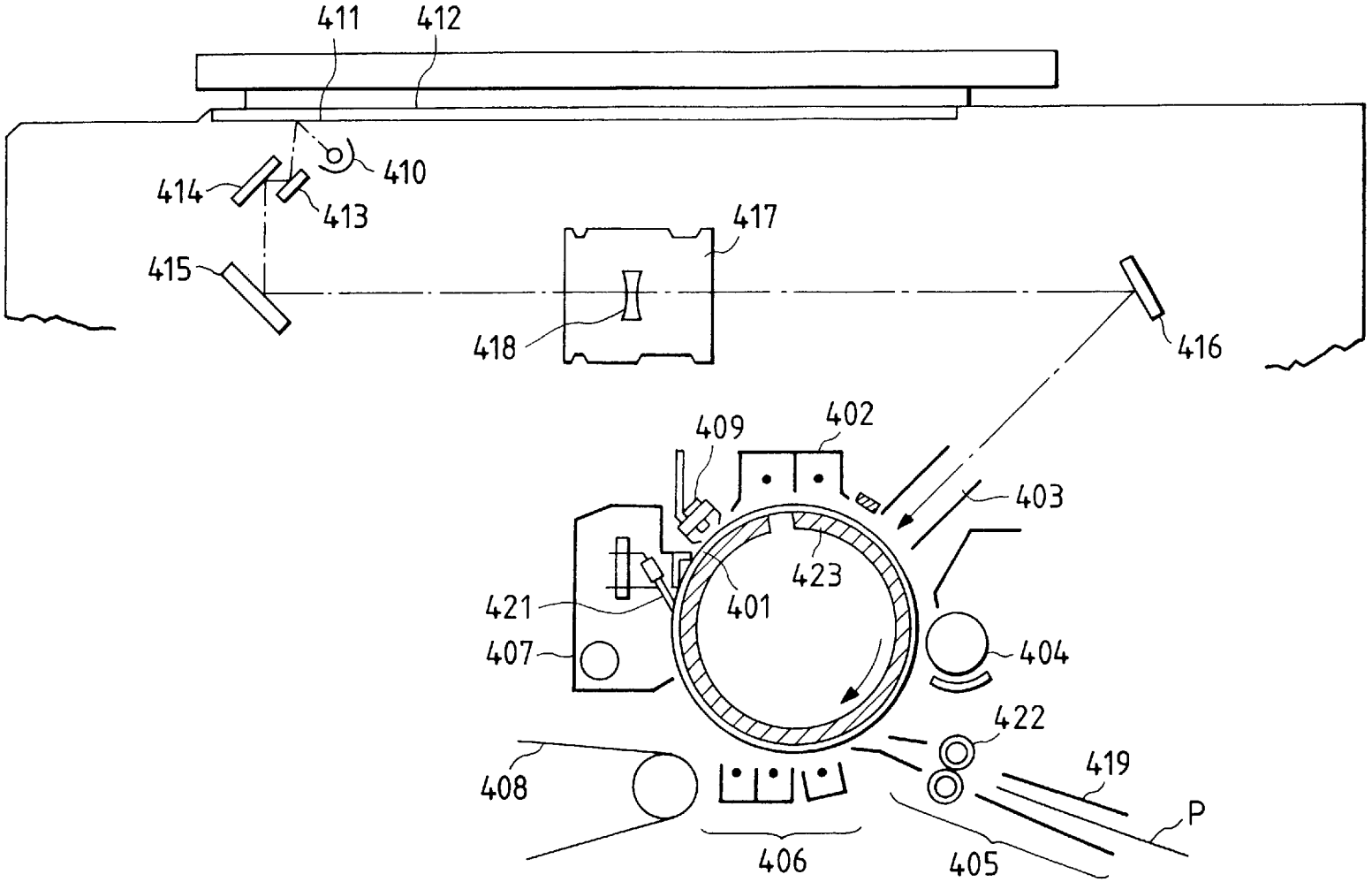
FIG. 2 is a diagrammatic structural view to illustrate an example of an electrophotographic apparatus having a heater for heating a light-receiving member.

The electrophotographic image formation using the light-receiving member of the present invention is carried out by the same procedure as that described in the apparatus shown in FIG. 2. In the present invention, what are different therefrom are that images are formed using the light-receiving member constituted as previously described and that no control for heating the light-receiving member is required since no heater therefor is provided. Using the apparatus constituted as shown in FIG. 5, images are formed in the following way.

First, while the light-receiving member 201 is rotated in the direction of an arrow, uniform corona charging is applied onto the light-receiving member by the primary charging unit 202. Then, light which has been emitted from the light source 210 is made incident on the original 212 put on the platen glass 211. The light reflected therefrom is led onto the surface of the light-receiving member through the mirrors 213 to 216, the lens system 217 and the filter 218, and projected thereon to form an electrostatic latent image. Then a toner is fed to this latent image from the developing unit 204 to form a toner image.

Meanwhile, a transfer medium P such as a sheet of paper or plastic is fed in the direction of the light-receiving member through the transfer medium feed system 205 having the transfer medium path 219 and the resist roller 222. An electric field with a polarity reverse to that of the toner is imparted on its back and at the gap between the transfer/separation charging unit 206 and the light-receiving member 201. As a result, the toner image on the surface of the light-receiving member is transferred to the transfer medium P and is separated from the light-receiving member 201.

The transfer medium P thus separated is passed through the transfer medium transport system 208 to a fixing unit (not shown), where the toner image is fixed, and then the transfer medium P is put out of the apparatus.

In the transfer zone, the residual toner remaining on the surface of the light-receiving member without contributing to the transfer comes to the cleaner 207 and is removed by a cleaning blade 221, so that the surface of the light-receiving member is cleaned.

The surface of the light-receiving member refreshed as a result of the cleaning is subjected to charge elimination exposure applied from the charge elimination light source 209 and is again used alike cyclingly.

The present invention will be described below in greater detail by giving Experiments.

Experiment 1

Using the RF plasma-assisted CVD apparatus as shown in FIG. 4, films were formed on an aluminum cylinder of 108 mm diameter, 358 mm long and 5 mm thick according to the procedure as previously described and under film forming conditions as shown in Table 1, to produce a light-receiving member having the layer configuration as shown in FIG. 3B. The light-receiving member was set in an electrophotographic image forming apparatus, a copying machine NP-7550, manufactured by CANON INC., modified for experimental purposes. In the present Experiment, the experiment was made in an environment of high temperature and high humidity, without providing the heater for heating the light-receiving member as in the image forming process previously described. Accordingly, the light-receiving member had substantially the same temperature (about 30° C.) as room temperature.

In the present Experiment, boron was selected as the Group III element contained in the third layer, and the content of boron was varied to become 100 atomic ppm, 300 atomic ppm, 1,000 atomic ppm, 3,000 atomic ppm, 1 atomic %, 10 atomic %, 20 atomic % and 30 atomic %. Using the resulting light-receiving members, images were reproduced in an environment of high temperature and high humidity, and evaluation was made on smeared images and potential contrast in the manner as shown below.

Figure 6:
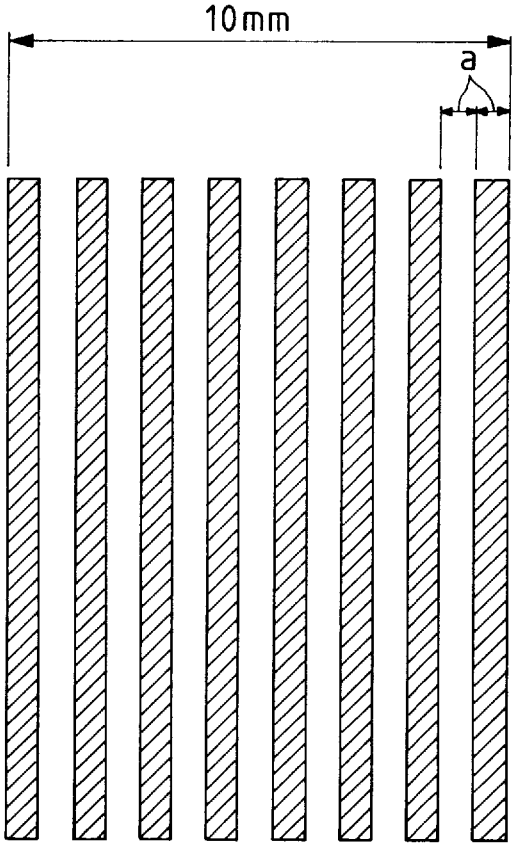
FIG. 6 is a schematic view to illustrate an example of a test chart.

Smeared Images:

Images were formed in an environment of high temperature and high humidity (temperature: 30° C.; relative humidity: 85%). Test charts each composed of black lines and white lines arranged at constant width a as shown in FIG. 6 were prepared as originals when the images were formed. Making the line width narrower, the line images were reproduced as copied images to make evaluation on the basis of a minimum line width a at which the images can be resolved. More specifically, when test charts on which the line width a is made narrower are copied, minute blurs due to smeared images at contours of black lines adjoining to each other on an image overlap one another at a certain line width a or below, where it actually becomes impossible to resolve the image. The line width a at the time it became so was regarded as the numerical value indicating a degree of smeared images.

Potential Contrast:

A light-receiving member was put on a test apparatus and its dark portion surface potential at a developing position was measured by applying a high voltage of +6 kV to a charging unit to generate corona discharge and using a surface potentiometer. The surface potential of the light-receiving member is charged to have a given dark portion surface potential (herein 400 V) at the development position. Then, at once, light from which light in a long wavelength region of 550 nm or above has been removed by using a filter is irradiated at 0.5 lux·sec thereon from a halogen lamp used as a light source, and a light portion surface potential is measured. The numerical value thus obtained was regarded as potential contrast which is a difference between the dark portion surface potential and the light portion surface potential.

Comparative Experiment 1

A light-receiving member having the layer configuration as shown in FIG. 1 was produced in the same manner as in Experiment 1, but under film forming conditions as shown in Table 2, and images were formed in the same manner as in Experiment 1 to make evaluation similarly.

Figure 7A:
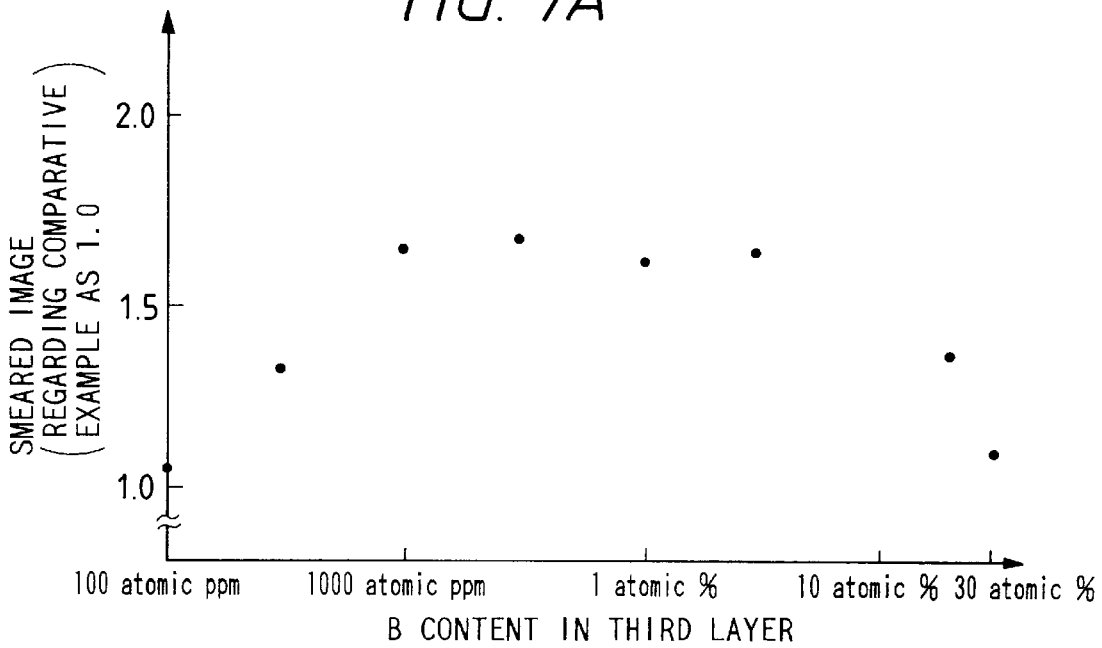
FIG. 7A is a graph showing an example of the relationship between a B (boron) content in the third layer and the prevention of smeared images.
Figure 7B:
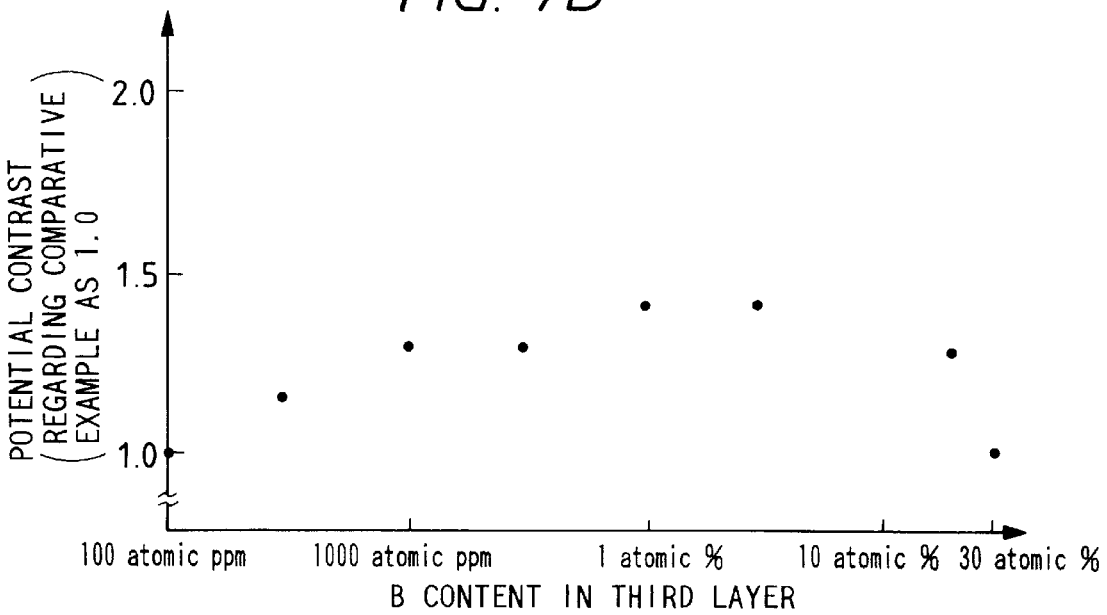
FIG. 7B is a graph showing an example of the relationship between a B content in the third layer and degree of potential contrast.

Results of evaluation made in the above Experiment 1 and Comparative Experiment 1 are shown in FIGS. 7A and 7B. The results on smeared images and potential contrast are indicated as relative evaluation, regarding the results of Comparative Experiment as 1 and indicating the numerical values which increase with an increase in the extent of improvement.

As shown in FIGS. 7A and 7B, in comparison of the light-receiving member of Experiment 1 with that of Comparative Experiment 1, performances showing less smeared images and better potential contrast were obtained under all conditions in Experiment 1 where the light-receiving member of the present invention was used. In particular, the incorporation of boron in the third layer was found to be remarkably effective in a content ranging from 300 atomic ppm, preferably from 1,000 atomic ppm, to 20 atomic %.

Experiment 2

Electrophotographic photosensitive drums were produced in the same manner as the light-receiving member of Experiment 1 except that the second layer was removed therefrom. The B (boron) content in the third layer was varied in four levels to become 100 atomic ppm, 300 atomic ppm, 10 atomic % and 20 atomic %. In the same manner as in Experiment 1, the photosensitive drums thus produced were each set in an electrophotographic image forming apparatus, a copying machine NP-7550, manufactured by CANON INC., modified for experimental purposes, and the surface potential of each photosensitive drum was measured at the development position when a high voltage of +6 kV was applied to a charging unit and a black original was copied. On the photosensitive drum with boron content of 100 atomic ppm in the third layer, a potential of 350 V was observed, while it was 50 V or below on all the photosensitive drums with boron content of 300 atomic ppm, 10 atomic % and 20 atomic %. From these results, it was possible to confirm that charged carriers passed through the third layer depending on the boron content. In respect of the drums with boron content of 300 atomic ppm, 10 atomic % and 20 atomic %, the hole mobility was calculated from the layer thickness of the third layer, process speed and charging electric current to reveal that it was $5\times10^{-9}$ $cm^2/v\cdot s$ or above in all the photosensitive drums. Since the surface potential of 350 V is observed on the photosensitive drum with boron content of 100 atomic ppm in its third layer, it is difficult to consider that the charged carriers have substantially passed through the third layer, and hence the hole mobility is considered smaller than $5\times10^{-9}$ $cm^2/v\cdot s$. As is seen from this experiment, the present invention can be remarkably effective when the hole mobility in the third layer is in the range of $5\times10^{-9}$ $cm^2/v\cdot s$ or above.

Experiment 3

Using the RF plasma-assisted CVD apparatus as shown in FIG. 4, films were formed on an aluminum cylinder of 108 mm diameter, 358 mm long and 5 mm thick according to the procedure as previously described and under film forming conditions as shown in Table 3, to produce a light-receiving member having the layer configuration as shown in FIG. 3A. The light-receiving member was set in an electrophotographic image forming apparatus, a copying machine NP-7550, manufactured by CANON INC., modified for experimental purposes. In the present Experiment, the experiment was made in the environment of high temperature and high humidity, without providing the heater for heating the light-receiving member as in the image forming process previously described. Accordingly, the light-receiving member had substantially the same temperature (about 30° C.) as room temperature.

In the present Experiment, the content of carbon atoms incorporated into the second layer was varied to become 10 atomic %, 20 atomic %, 30 atomic %, 50 atomic %, 70 atomic % and 90 atomic % to produce corresponding light-receiving members. Using the resulting light-receiving members, images were reproduced in the environment of high temperature and high humidity, and evaluation was made on smeared images in the same manner as in Experiment 1, and on charging performance in the manner as shown below.

Charging Performance:

The electrophotographic light-receiving member was set in the experimental apparatus, and a high voltage of +6 kV was applied to a charging unit to carry out corona charging. The dark portion surface potential of the electrophotographic light-receiving member was measured using a surface potentiometer.

Figure 8A:
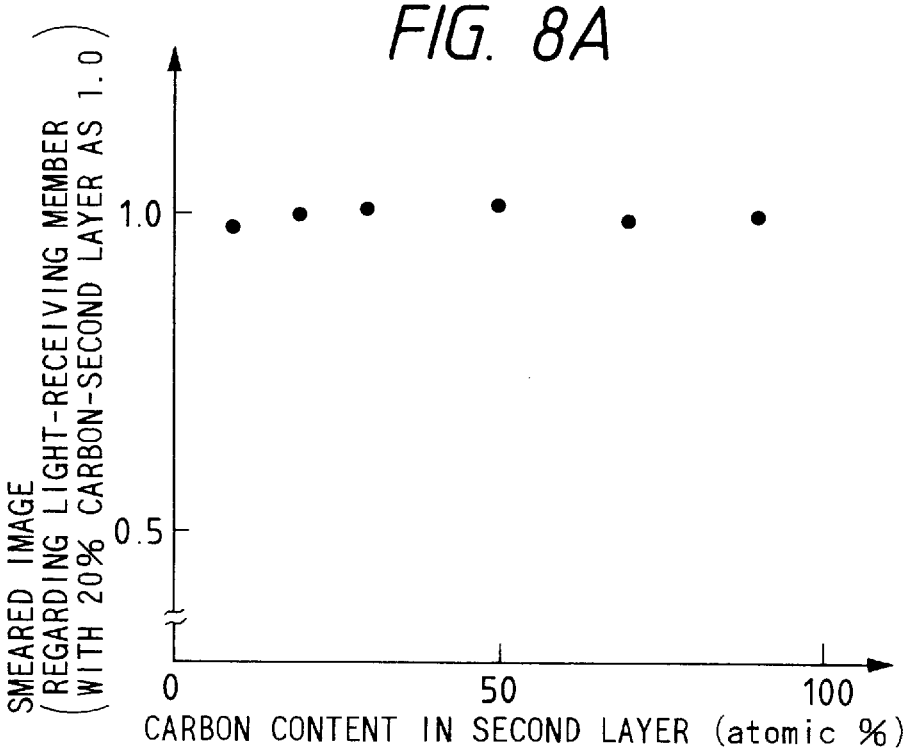
FIG. 8A is a graph showing an example of the relationship between a carbon content in the second layer and prevention of smeared images.
Figure 8B:
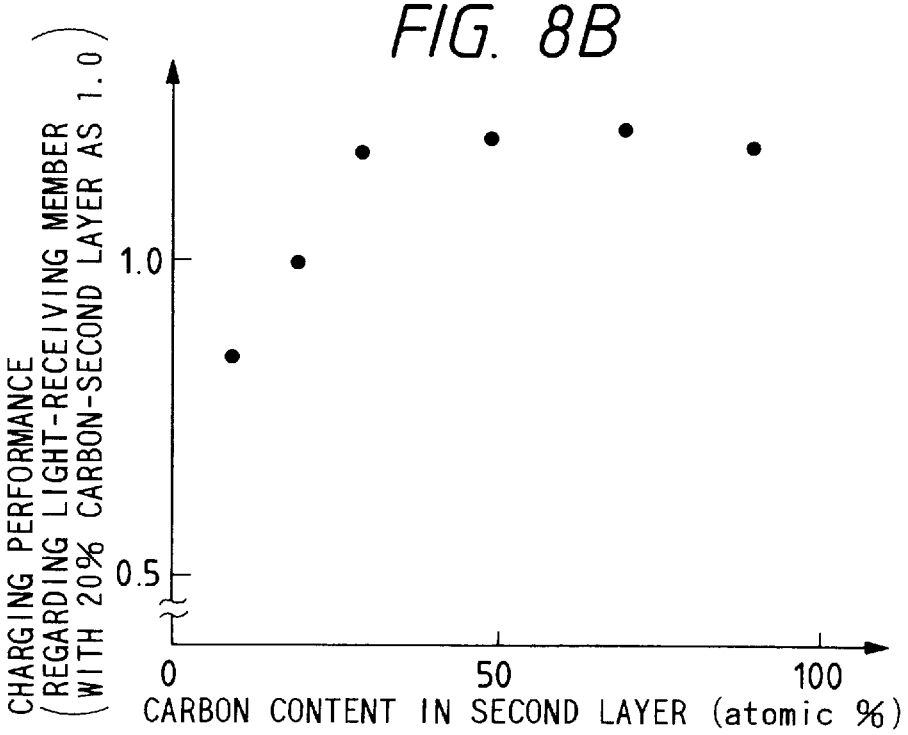
FIG. 8B is a graph showing an example of the relationship between a carbon content in the second layer and charging performance.

Results of evaluation made in the above Experiment 3 are shown in FIGS. 8A and 8B. The results on smeared images and charging performance are indicated as relative evaluation, regarding the result of the light-receiving member with carbon of 20 atomic % in the second layer in Experiment 3 as 1 and indicating the numerical values which increase with an increase in the extent of prevention of smeared images and with an improvement in charging performance.

As shown in FIGS. 8A and 8B, the light-receiving members in Experiment 3 caused less smeared images and showed good results in all the cases when the content of carbon atoms in the second layer was 30 atomic % to 90 atomic %. With regard to the charging performance, no satisfactory results were obtained in the case of the light-receiving member with the carbon atom content of 10 atomic % or 20 atomic %. From these results, the content of carbon atoms in the second layer has proved preferable when it is 30 atomic % to 90 atomic %.

Experiment 4

Using the RF plasma-assisted CVD apparatus as shown in FIG. 4, films were formed on an aluminum cylinder of 108 mm diameter, 358 mm long and 5 mm thick according to the procedure as previously described and under film forming conditions as shown in Table 4, to produce a light-receiving member having the layer configuration as shown in FIG. 3A. The light-receiving member was set in an electrophotographic image forming apparatus, a copying machine NP-7550, manufactured by CANON INC., modified for experimental purposes. In the present Experiment, the experiment was made in the environment of high temperature and high humidity, without providing the heater for heating the light-receiving member as in the image forming process previously described. Accordingly, the light-receiving member had substantially the same temperature (about 30° C.) as room temperature.

In the present Experiment, the content of carbon atoms incorporated into the third layer was varied to become 1 atomic %, 10 atomic %, 50 atomic %, 70 atomic % and 90 atomic %. Using the resulting light-receiving members, images were reproduced in the environment of high temperature and high humidity, and evaluation was made on smeared images and potential contrast in the same manner as in Experiment 1.

As the result, all the light-receiving members caused less smeared images and showed good potential contrast as in the case of the light-receiving members of Experiment 1. From this result, the content of carbon atoms in the third layer has proved preferable when it is 1 atomic % to 90 atomic %.

The present invention will be described below by giving Examples. The present invention is by no means limited by these Examples.

EXAMPLE 1

Light-receiving members having the layer configuration as shown in FIG. 3B were produced according to the procedure as, previously described and under film forming conditions as shown in Table 5. In the present Example, $B_2H_6$ for the third layer was fed in a concentration of 300 ppm, 5,000 ppm, 1%, 10% or 20% based on $SiH_4$, to produce five kinds of light-receiving members. The light-receiving members thus produced were each set in an electrophotographic image forming apparatus, a copying machine NP-7550, manufactured by CANON INC., modified for experimental purposes. To make image evaluation, a check sheet NA-7, available from CANON INC., was used and image quality of the images formed was visually judged. Here, as the toner, an insulating toner having a volume average particle diameter of 5 $\mu$m was used.

Images were formed in a normal environment (temperature: 23° C.; relative humidity: 60%) to make evaluation. As a result, when Chinese characters "驚" "電" drawn on the check sheet in about 2 mm square each were reproduced, the four-cornered boxy component "口" did not crush in the Chinese character "驚" and, in the Chinese character "電", the horizontal strokes in the crown part "雨" did not overlap one another. Thus, good images with a clear white and black contrast were obtained. When the whole image was viewed, it was a very good image having a high density, being free from fog and having a clear contrast. A photograph was also chosen as an image for evaluation, and the image was reproduced to make evaluation. As a result, it was found that the halftone was well reproduced and also the gradation was well superior. In this image reproduction, the temperature was not controlled at all by, e.g., providing a heater inside the light-receiving member, and accordingly the light-receiving member had substantially the same temperature (about 23° C.) as room temperature. Images were also formed in an environment of high temperature and high humidity (temperature: 30° C.; relative humidity: 85%) to make evaluation similarly. As a result, sharp images with a good contrast were obtained which were quite comparable to those formed in the normal environment. For the same reason, the light-receiving member had substantially the same temperature (about 30° C.) as room temperature.

Carbon content in each of the second and third layers of the light-receiving members produced in the present Example was also analyzed by SIMS (secondary ion mass spectroscopy) to reveal that it was 65 atomic % and 41 atomic %, respectively. The hole mobility in the third layer was also calculated from the layer thickness and surface potential of the third layer, process speed and charging electric current to reveal that it was $3\times10^{-7}$ $cm^2/v\cdot s$ or above.

In addition, a heater was provided inside the light-receiving member produced in the present Example to keep the temperature at 50° C., where the same evaluation as the above was made. The results obtained were entirely the same as the above. Thus, the present invention has proved to be well effective also when the light-receiving member stands at any temperature of from room temperature to 50° C.

EXAMPLE 2

A light-receiving member having the layer configuration as shown in FIG. 3A, produced under conditions as shown in Table 6 was set in an electrophotographic image forming apparatus, a copying machine NP-7550, manufactured by CANON INC., modified for experimental purposes. Images were reproduced and evaluated in the same manner as in Example 1. Here, as the toner, an insulating toner having a volume average particle diameter of 8.5 $\mu$m was used. As the result, it was found that the same good image reproducibility as in Example 1 was achieved on both the CANON's check sheet NA-7 and the photograph, showing superior resolution and gradation.

EXAMPLE 3

Using a light-receiving member produced in entirely the same manner as in Example 2 except that the material gas $CH_4$ for forming the second layer was replaced with $N_2$ (i.e., nitrogen atoms are contained in the second layer in place of carbon atoms), the image reproduction and evaluation were made in the same manner as in Example 2. As a result, the same good results as in Example 2 were obtained.

EXAMPLE 4

Using a light-receiving member produced in entirely the same manner as in Example 2 except that the material gas $CH_4$ for forming the second layer was replaced with NO (i.e., nitrogen atoms and oxygen atoms are contained in the second layer in place of carbon atoms), the image reproduction and evaluation were made in the same manner as in Example 2. As a result, the same good results as in Example 2 were obtained.

EXAMPLE 5

A light-receiving member having the layer configuration as shown in FIG. 3A, produced under conditions as shown in Table 7 was set in an electrophotographic image forming apparatus, a copying machine NP-7550, manufactured by CANON INC., modified for experimental purposes. Images were reproduced and evaluated in the same manner as in Example 1. Here, as the toner, an insulating toner having a volume average particle diameter of 9 $\mu$m was used. As the result, the same results as in Example 1 were obtained and the light-receiving member having the third layer containing SiN was found to be also effective as in the case of SiC.

EXAMPLE 6

A light-receiving member having the layer configuration as shown in FIG. 3B, produced under conditions as shown in Table 8 was set in an electrophotographic image forming apparatus, a copying machine NP-7550, manufactured by CANON INC., modified for experimental purposes. Images were reproduced and evaluated in the same manner as in Example 1. Here, as the toner, an insulating toner having a volume average particle diameter of 4.5 $\mu$m was used. As the result, the same results as in Example 1 were obtained and the light-receiving member having the third layer containing SiO was found to be also effective as in the case of SiC.

TABLE 1

| Layer | Material gas | Gas flow rate (sccm) | Discharge power (W) | Internal pressure (Torr) | Support temperature (°C.) | Layer thickness ($\mu$m) |
|---|---|---|---|---|---|---|
| Lower blocking layer: | $SiH_4$ | 100 | | | | |
| | $H_2$ | 500 | 150 | 0.5 | 250 | 5 |
| | NO | 5 | | | | |
| | $B_2H_6/SiH_4$ | 1,500 ppm | | | | |
| First layer: | $SiH_4$ | 300 | | | | |
| | $H_2$ | 500 | 500 | 0.5 | 250 | 15 |
| | $B_2H_6/SiH_4$ | 0.5 ppm | | | | |
| Second layer: | $SiH_4$ | 100 | 150 | 0.4 | 250 | 0.5 |
| | $CH_4$ | 600 | | | | |
| Third layer: | $SiH_4$ | 100 | | | | |
| | $CH_4$ | 500 | 300 | 0.4 | 250 | 1 |
| | $B_2H_6/SiH_4$ | (Varied) | | | | |

TABLE 2

| Layer | Material gas | Gas flow rate (sccm) | Discharge power (W) | Internal pressure (Torr) | Support temperature (°C.) | Layer thickness ($\mu$m) |
|---|---|---|---|---|---|---|
| Lower blocking layer: | $SiH_4$ | 100 | | | | |
| | $H_2$ | 500 | 150 | 0.5 | 250 | 5 |
| | NO | 5 | | | | |
| | $B_2H_6/SiH_4$ | 1,500 ppm | | | | |
| Photo-conductive layer: | $SiH_4$ | 50 | | | | |
| | $H_2$ | 500 | 500 | 0.5 | 250 | 15 |
| | $B_2H_6/SiH_4$ | 0.5 ppm | | | | |
| Surface | $SiH_4$ | 100 | 150 | 0.4 | 250 | 1 |

TABLE 2-continued

| Layer | Material gas | Gas flow rate (sccm) | Discharge power (W) | Internal pressure (Torr) | Support temperature (°C.) | Layer thickness ($\mu$m) |
|---|---|---|---|---|---|---|
| protective layer: | $CH_4$ | 600 | | | | |

TABLE 3

| Layer | Material gas | Gas flow rate (sccm) | Discharge power (W) | Internal pressure (Torr) | Support temperature (°C.) | Layer thickness ($\mu$m) |
|---|---|---|---|---|---|---|
| First layer: | $SiH_4$ | 150 | | | | |
| | $H_2$ | 500 | 100 | 0.6 | 250 | 35 |
| Second layer: | $SiH_4$ | 50 | | | | |
| | $CH_4$ | (Varied) | 150 | 0.5 | 250 | 1 |
| Third layer: | $SiH_4$ | 100 | 150 | 0.5 | 250 | 1 |
| | $CH_4$ | 300 | | | | |
| | $B_2H_6/SiH_4$ | 3% | | | | |

TABLE 4

| Layer | Material gas | Gas flow rate (sccm) | Discharge power (W) | Internal pressure (Torr) | Support temperature (°C.) | Layer thickness ($\mu$m) |
|---|---|---|---|---|---|---|
| First layer: | $SiH_4$ | 150 | | | | |
| | $H_2$ | 500 | 100 | 0.6 | 250 | 35 |
| Second layer: | $SiH_4$ | 50 | | | | |
| | $CH_2$ | 500 | 150 | 0.5 | 250 | 1 |
| Third layer: | $SiH_4$ | 100 | 150 | 0.5 | 250 | 0.5 |
| | $CH_4$ | (Varied) | | | | |
| | $B_2H_6/SiH_4$ | 20% | | | | |

TABLE 5

| Layer | Material gas | Gas flow rate (sccm) | Discharge power (W) | Internal pressure (Torr) | Support temperature (°C.) | Layer thickness ($\mu$m) |
|---|---|---|---|---|---|---|
| Lower blocking layer: | $SiH_4$ | 200 | | | | |
| | $H_2$ | 500 | 200 | 0.5 | 250 | 3 |
| | NO | 1 | | | | |
| | $B_2H_6/SiH_4$ | 2,000 ppm | | | | |
| First layer: | $SiH_4$ | 100 | | | | |
| | $H_2$ | 800 | 500 | 0.5 | 250 | 30 |
| | $B_2H_6/SiH_4$ | 0.5 ppm | | | | |
| Second layer: | $SiH_4$ | 100 | 200 | 0.5 | 250 | 2 |
| | $CH_4$ | 600 | | | | |
| Third layer: | $SiH_4$ | 100 | | | | |
| | $CH_4$ | 400 | 300 | 0.5 | 250 | 0.5 |
| | $B_2H_6/SiH_4$ | (Varied) | | | | |

TABLE 6

| Layer | Material gas | Gas flow rate (sccm) | Discharge power (W) | Internal pressure (Torr) | Support temperature (°C.) | Layer thickness ($\mu$m) |
|---|---|---|---|---|---|---|
| First layer: | $SiH_4$ | 150 | | | | |
| | $H_2$ | 500 | 100 | 0.6 | 250 | 35 |

TABLE 6-continued

| Layer | Material gas | Gas flow rate (sccm) | Discharge power (W) | Internal pressure (Torr) | Support temperature (°C.) | Layer thickness (μm) |
|---|---|---|---|---|---|---|
| Second layer: | $SiH_4$ | 50 | | | | |
| | $CH_4$ | 500 | 150 | 0.5 | 250 | 2 |
| Third layer: | $SiH_4$ | 100 | 150 | 0.5 | 250 | 2 |
| | $CH_4$ | 300 | | | | |
| | $B_2H_6/SiH_4$ | 1,000 ppm | | | | |

TABLE 7

| Layer | Material gas | Gas flow rate (sccm) | Discharge power (W) | Internal pressure (Torr) | Support temperature (°C.) | Layer thickness (μm) |
|---|---|---|---|---|---|---|
| First layer: | $SiH_4$ | 300 | | | | |
| | $H_2$ | 500 | 300 | 0.6 | 250 | 20 |
| Second layer: | $SiH_4$ | 80 | | | | |
| | $CH_4$ | 600 | 150 | 0.5 | 250 | 0.2 |
| Third layer: | $SiH_4$ | 50 | 150 | 0.5 | 250 | 0.6 |
| | $N_2$ | 200 | | | | |
| | $B_2H_6/SiH_4$ | 1 ppm | | | | |

TABLE 8

| Layer | Material gas | Gas flow rate (sccm) | Discharge power (W) | Internal pressure (Torr) | Support temperature (°C.) | Layer thickness (μm) |
|---|---|---|---|---|---|---|
| Lower blocking layer: | $SiH_4$ | 200 | | | | |
| | $H_2$ | 500 | 200 | 0.5 | 250 | 1 |
| | NO | 5 | | | | |
| | $B_2H_6/SiH_4$ | 2,000 ppm | | | | |
| First layer: | $SiH_4$ | 200 | | | | |
| | $H_2$ | 800 | 500 | 0.5 | 250 | 35 |
| | $B_2H_6/SiH_4$ | 0.5 ppm | | | | |
| Second layer: | $SiH_4$ | 50 | 300 | 0.5 | 250 | 0.5 |
| | $CH_4$ | 600 | | | | |
| Third layer: | $SiH_4$ | 30 | | | | |
| | NO | 200 | 300 | 0.5 | 250 | 0.5 |
| | $B_2H_6/SiH_4$ | 4% | | | | |

As described above, the present invention makes it possible to provide a light-receiving member that requires no heating mechanism for heating the light-receiving member and can achieve a very good image quality, and an electrophotographic apparatus having such a light-receiving member.

The present invention also makes it possible to obtain images having a very stable and good sharpness without dependence on environment.

The present invention still also makes it possible to provide an electrophotographic apparatus that requires less power consumption on the whole, is economical and also has a low impact upon global environment, and a light-receiving member most suitably usable in such an apparatus.

The present invention employs the materials of a non-single-crystal silicon type under the specific constitution as the light-receiving member and specifies the content of the periodic table Group III element in the third layer and the hole mobility in that layer. Hence, the present invention further makes it possible to stably obtain copied images with a superior image quality, having a very higher sharpness, without dependence on environment.

Needless to say, the present invention should be by no means construed restrictively by the foregoing description, and gives a possibility of appropriate modification and combination within the scope of gist of the present invention.

What is claimed is:

1. A light-receiving member comprising on a conductive support in this order:

a first layer from 1 μm to 100 μm in thickness exhibiting photoconductivity and comprising a nonsingle crystal material comprising silicon as a matrix;

a second layer comprising a non-single-crystal material comprising silicon and at least one element selected from the group consisting of carbon, nitrogen and oxygen, and having a thickness less than the thickness of the first layer; and a third layer comprising a non-single-crystal material comprising silicon and at least one element selected from the group consisting of carbon, nitrogen and oxygen;

wherein the light-receiving member is positively chargeable, and wherein the third layer further contains at least one element belonging to Group III of the Periodic Table as an impurity having the same polarity as the polarity to which the light-receiving member is charged, said at least one element in said third layer is present in amounts of at least 300 atomic ppm.

2. The light-receiving member according to claim 1, wherein said first layer further comprises a Group III element of the periodic table.

3. The light-receiving member according to claim 2, wherein said Group III element of the periodic table, to be contained in said first layer is boron.

4. The light-receiving member according to claim 1, wherein the at least one Group III element in the third layer is in a concentration no greater than 20 atomic %.

5. The light-receiving member according to claim 4, wherein said Group III element of the periodic table, to be contained in said third layer is boron.

6. The light-receiving member according to claim 1, wherein said third layer has a hole mobility of at least $5\times10^{-9}$ $cm^2/v\cdot s$.

7. The light-receiving member according to claim 1, wherein the total content of carbon atoms, nitrogen atoms and oxygen atoms in said second layer is in a range of from 30 atomic % to 90 atomic % with respect to the total content of silicon atoms, carbon atoms, nitrogen atoms and oxygen atoms in said second layer.

8. The light-receiving member according to claim 1, wherein the total content of carbon atoms, nitrogen atoms and oxygen atoms in said third layer is in a range of from 1 atomic % to 90 atomic % with respect to the total content of silicon atoms, carbon atoms, nitrogen atoms and oxygen atoms in said third layer.

9. The light-receiving member according to claim 1, wherein said second layer further comprises hydrogen atoms or halogen atoms.

10. The light-receiving member according to claim 1, wherein said third layer further comprises hydrogen atoms or halogen atoms.

11. The light-receiving member according to claim 1, wherein said third layer has a layer thickness of from 0.2 μm to 10 μm.

12. The light-receiving member according to claim 10, wherein said first layer further comprises a Group III element of the periodic table.

13. The light-receiving member according to claim 12, wherein said Group III element of the periodic table to be contained in said first layer is boron.

14. The light-receiving member according to claim 10, wherein the at least one Group III element in the third layer is in a concentration no greater than 20 atomic %.

15. The light-receiving member according to claim 14, wherein said Group III element of the periodic table to be contained in said third layer is boron.

16. The light-receiving member according to claim 10, wherein said third layer has a hole mobility of at least $5\times10^{-9}$ $cm^2/v\cdot s$.

17. The light-receiving member according to claim 10, wherein the total content of carbon atoms, nitrogen atoms and oxygen atoms in said second layer is in the range of from 30 atomic % to 90 atomic % with respect to the total content of silicon atoms, carbon atoms, nitrogen atoms and oxygen atoms in said second layer.

18. The light-receiving member according to claim 10, wherein the total content of carbon atoms, nitrogen atoms and oxygen atoms in said third layer is in the range of from 1 atomic % to 90 atomic % with respect to the total content of silicon atoms, carbon atoms, nitrogen atoms and oxygen atoms in said third layer.

19. An electrophotographic apparatus comprising the light-recieving member according to claim 1, and an insulating toner having a volume average particle diameter of from 4.5 μm to 9.0 μm.

20. The light-receiving member according to claim 1, wherein said light-receiving member is capable of being used at a temperature of 10° C. to 50° C.

21. An electrophotographic apparatus comprising the light-receiving member according to claim 1.

22. The electrophotographic apparatus according to claim 21, which has no heater for heating the light-receiving member.

23. The light-receiving member according to claim 1, wherein a blocking layer is further provided between the conductive support and the first layer.

24. The light-receiving member according to claim 23, wherein the blocking layer comprises an amorphous material comprising silicon atoms as a matrix and an element belonging to Group III of the Periodic Table.

25. The light-receiving member according to claim 24, wherein the element belonging to Group III is boron.

26. A light-receiving member, comprising on a conductive support in this order:

a blocking layer comprising a non-single-crystal material comprising silicon as a matrix containing an element of Group III of the Periodic Table;

a first layer exhibiting photoconductivity comprising a non-single-crystal material comprising silicon as a matrix;

a second layer comprising (a) a non-single-crystal material comprising silicon and (b) at least one element selected from the group consisting of carbon, nitrogen and oxygen; and a third layer comprising (i) a non-single-crystal material comprising silicon (ii) the same elements as the at least one element of the second layer and (iii) an element of Group III of the Periodic Table, said element of Group III in the third layer being present in amounts of at least 300 atomic ppm.

27. The light-receiving member according to claim 26, wherein the first layer further contains an element belonging to Group III of the Periodic Table.

28. The light-receiving member according to claim 27, wherein the element to be contained in the first layer is boron.

29. The light-receiving member according to claim 26, wherein the Group III element contained in the third layer is in a concentration no greater than 20 atomic %.

30. The light-receiving member according to claim 29, wherein the element is boron.

31. The light-receiving member according to claim 26, wherein the third layer has a hole mobility of at least $5\times10^{-9}$ $cm^2/v.\ s.$ 32. The light-receiving member according to claim 26, wherein the total content of carbon atoms, nitrogen atoms and oxygen atoms in the second layer is in a range of 30 atomic % to 90 atomic % with respect to the total content of silicon atoms, carbon atoms, nitrogen atoms and oxygen atoms in the second layer.

33. The light-receiving member according to claim 26, wherein the total content of carbon atoms, nitrogen atoms and oxygen atoms in the third layer is in a range of 1 atomic % to 90 atomic % with respect to the total content of silicon atoms, carbon atoms, nitrogen atoms and oxygen atoms in the third layer.

34. The light-receiving member according to claim 26, wherein the second layer further contains hydrogen atoms or halogen atoms.

35. The light-receiving member according to claim 26, wherein the third layer further contains hydrogen atoms or halogen atoms.

36. The light-receiving member according to claim 26, wherein the third layer has a thickness of 0.2 μm to 10 μm.

37. The light-receiving member according to claim 35, wherein the first layer further contains an element belonging to Group III of the Periodic Table.

38. The light-receiving member according to claim 37, wherein the element to be contained in the first layer is boron.

39. The light-receiving member according to claim 35, wherein the element to be contained in the third layer is in a concentration of 0.03 atomic % to 20 atomic %.

40. The light-receiving member according to claim 35, wherein the Group III element contained in the third layer is boron.

41. The light-receiving member according to claim 35, wherein the third layer has a hole mobility of at least $5\times10^{-9}$ $cm^2/v.\ s.$ 42. The light-receiving member according to claim 35, wherein the total content of carbon atoms, nitrogen atoms and oxygen atoms in the second layer is in a range of 30 atomic % to 90 atomic % with respect to the total content of silicon atoms, carbon atoms, nitrogen atoms and oxygen atoms in the second layer.

43. The light-receiving member according to claim 35, wherein the total content of carbon atoms, nitrogen atoms and oxygen atoms in the third layer is in a range of 1 atomic % to 90 atomic % with respect to the total content of silicon atoms, carbon atoms, nitrogen atoms in the third layer.

44. The light-receiving member according to claim 26, wherein the second layer further contains an element belonging to Group III or Group V of the Periodic Table.

45. The light-receiving member according to claim 44, wherein the amount of the element of Group III or Group V in the second layer is less than the amount of the element of Group III in the third layer.

46. An electrophotographic apparatus comprising the light-receiving member according to claim 26, and an insulating toner having a volume average particle diameter of 4.5 μm to 9.0 μm.

47. The light-receiving member according to claim 26, wherein the light-receiving member is capable of being used at a temperature of 10° C. to 50° C.

48. An electrophotographic apparatus comprising the light-receiving member of claim 26.

49. The electrophotographic apparatus according to claim 48, which operates without a heater for heating the light-receiving member.

50. A method of forming an image which comprises:

(a) positively charging a surface of a light-receiving member, said light-receiving member comprising on a conductive support in order, (i) a first layer exhibiting photoconductivity from 1 $\mu$m to 100 $\mu$m in thickness and comprising a non-single-crystal material comprising silicon as a matrix, (ii) a second layer comprising a non-single-crystal material comprising silicon and at least one element selected from the group consisting of carbon, nitrogen and oxygen, and having a thickness smaller than the thickness of the first layer, and (iii) a third layer comprising a non-single-crystal material comprising silicon and at least one element selected from the group consisting of carbon, nitrogen and oxygen, wherein the third layer further contains at least one element of Group III of the Periodic Table present in amounts of at least 300 atomic ppm as an impurity having the same polarity as the polarity to which the light-receiving member is charged;

(b) irradiating the charged light-receiving member with image information to form an electrostatic image; and (c) applying a toner to the electrostatic image to form a toner image.

51. A method of forming an image which comprises:

(a) positively charging a surface of a light-receiving member, said light-receiving member comprising on a conductive support in order, (i) a blocking layer comprising a non-single-crystal material comprising silicon as a matrix containing an element of Group III of the Periodic Table, (ii) a first layer exhibiting conductivity comprising a non-single-crystal material comprising silicon as a matrix, (iii) a second layer comprising a non-single-crystal material comprising silicon and at least one element selected from the group consisting of carbon, nitrogen and oxygen, and (iv) a third layer comprising a non-single-crystal material comprising silicon, at least one element of the at least one element selected for the second layer and an element of Group III of the Periodic Table in an amount of at least 300 atomic ppm;

(b) irradiating the charged light-receiving member with image information to form an electrostatic image; and (c) applying a toner to the electrostatic image to form a toner image.

* * * * *

UNITED STATES PATENT AND TRADEMARK OFFICE

CERTIFICATE OF CORRECTION

PATENT NO. : 5,876,886

DATED : March 2, 1999

INVENTOR(S) : JUNICHIRO HASHIZUME

It is certified that error appears in the above-identified patent and that said Letters Patent is hereby corrected as shown below:

COLUMN 2

Line 51, "but," should read --but--.
Line 55, "example," should read --example, a--.
Line 56, "a" should be deleted.

COLUMN 4

Line 39, "effect" should read --effects--.

COLUMN 8

Line 1, "substances" should read --substance--.

COLUMN 13

Line 52, "as," should read --as--.

COLUMN 14

Line 1, Insert --and-- between Chinese characters

UNITED STATES PATENT AND TRADEMARK OFFICE

CERTIFICATE OF CORRECTION

PATENT NO. : 5,876,886

DATED : July 7, 1998

INVENTOR(S) : HIROSHI KABURAGI ET AL.

It is certified that error appears in the above-identified patent and that said Letters Patent is hereby corrected as shown below:

COLUMN 18

Line 1, "higher" should read --high--.
Line 11, "nonsingle crystal" should read --non-single-crystal--.
Line 27, "one" should read --one Group III--.

COLUMN 19

Line 24, "light-recieving" should read --light-receiving--.

COLUMN 20

Line 7, "$cm^2$/V.S." should read --$cm^2$/V·S.--.
Line 42, "$cm^2$/V.S." should read --$cm^2$/V·S.--.

Signed and Sealed this

Twelfth Day of October, 1999

*Attest:*

*Attesting Officer*

Q. TODD DICKINSON

*Acting Commissioner of Patents and Trademarks*